US008695616B2

(12) United States Patent
Huggins

(10) Patent No.: US 8,695,616 B2
(45) Date of Patent: Apr. 15, 2014

(54) ADJUSTABLE-WIDTH WALKER WITH REMOVABLE CANE

(76) Inventor: Jerry Huggins, Justin, TX (US)

( * ) Notice: Subject to any disclaimer, the term of this patent is extended or adjusted under 35 U.S.C. 154(b) by 0 days.

(21) Appl. No.: 13/050,676

(22) Filed: Mar. 17, 2011

(65) Prior Publication Data

US 2011/0226296 A1 Sep. 22, 2011

Related U.S. Application Data

(60) Provisional application No. 61/315,298, filed on Mar. 18, 2010.

(51) Int. Cl.
*A61H 3/00* (2006.01)

(52) U.S. Cl.
USPC ..... 135/66; 135/67; 135/76

(58) Field of Classification Search
USPC ..... 135/65, 66, 67, 75, 76
See application file for complete search history.

(56) References Cited

U.S. PATENT DOCUMENTS

| | | | | | |
|---|---|---|---|---|---|
| 768,452 | A * | 8/1904 | Hennessy | ..... | 135/65 |
| 2,796,916 | A * | 6/1957 | Womble | ..... | 135/67 |
| 2,817,387 | A | 12/1957 | Blake | | |
| 3,032,048 | A * | 5/1962 | Hoffmann | ..... | 135/71 |
| 4,094,330 | A | 6/1978 | Jong | | |
| 4,248,256 | A | 2/1981 | Thomas | | |
| 4,556,075 | A * | 12/1985 | Hoffman | ..... | 135/65 |
| 4,748,994 | A * | 6/1988 | Schultz et al. | ..... | 135/67 |
| 4,941,496 | A | 7/1990 | Berning | | |
| 4,995,412 | A | 2/1991 | Hirn et al. | | |
| 5,467,793 | A | 11/1995 | Hart | | |
| 5,769,104 | A * | 6/1998 | Uemura | ..... | 135/69 |
| 5,904,168 | A | 5/1999 | Alulyan | | |
| 6,607,202 | B1 | 8/2003 | Palmer | | |
| 7,021,324 | B1 * | 4/2006 | Clay et al. | ..... | 135/67 |
| 7,373,942 | B1 | 5/2008 | Yeager | | |
| 7,677,259 | B1 * | 3/2010 | Arbuckle et al. | ..... | 135/67 |
| 2008/0029139 | A1 * | 2/2008 | Pijanowski | ..... | 135/67 |
| 2010/0051076 | A1 | 3/2010 | McGann | | |

FOREIGN PATENT DOCUMENTS

| | | | |
|---|---|---|---|
| FR | 2535606 | A1 | 5/1984 |
| JP | 2002126023 | A | 5/2002 |

* cited by examiner

*Primary Examiner* — Noah Chandler Hawk
(74) *Attorney, Agent, or Firm* — Winstead PC

(57) ABSTRACT

The present invention relates to a walker. The walker includes a first front leg, a first rear leg; and a first handle disposed between and connecting the first front leg to the first rear leg. The walker further comprises a trough region formed in a top surface of the first handle. The trough region has a hole formed therein. The walker further includes a cane having a grip region and a body portion. The body portion of the cane is removably received within the hole and the grip region of the cane is removably received within the trough region.

19 Claims, 4 Drawing Sheets

ADJUSTABLE-WIDTH WALKER WITH REMOVABLE CANE

CROSS-REFERENCE TO RELATED APPLICATIONS

This application claims priority from and incorporates by reference the entire disclosure of U.S. Provisional Patent Application No. 61/315,298, filed Mar. 18, 2010.

BACKGROUND

1. Field of the Invention

The present invention relates to therapeutic assistive devices and more particularly, but not by way of limitation, to adjustable-width walkers having a removable integrated cane.

2. History of the Related Art

Therapeutic assistive devices such as walkers, canes, crutches, and the like have been used for many years to assist patients recovering from a variety of ailments such as, for example, strokes, traumatic injuries, and orthopedic surgeries. In particular, numerous varieties of walkers have been used to assist patients in regaining mobility following an injury or ailment. A typical walker, when viewed from above, forms a "C" shape thus allowing the patient to step inside the walker and grip a handle located on either side of the patient. Such an arrangement provides a stable base of support for the patient lacking requisite balance or muscular coordination to walk safely.

Existing walkers are effective in assisting patients with mobility or gait training; however, existing walkers suffer from a variety of limitations. For example, many existing walkers are of a fixed width. Fixed-width walkers may be difficult to maneuver indoors such as, for example, a home or an office. For example, most fixed-width walkers are too wide to pass though narrow doorways such as the type commonly found in older homes. In this situation, the patient typically steps backwards out of the walker, turns the walker sideways, lifts and places the walker through the doorway, and finally steps forward back into the walker. This may cause the patient to lose the base of support offered by the walker and may present a significant risk of fall and injury particularly if the patient has compromised balance or strength. In addition, significantly overweight patients may be too large to fit inside a frame of the fixed-width walker.

Furthermore, walkers are typically used during early stages of a patient's rehabilitation, and are typically not practical for use by a more advanced patient with better balance and strength. These more advanced patients typically transition from using a walker to using a cane. While a cane presents numerous maneuverability advantages over a walker, a cane may be problematic when a patient grows tired and requires a broader base of support offered by a walker. Furthermore, the cane is typically purchased separately from the walker thus increasing the cost to the patient.

SUMMARY

The present invention relates to therapeutic assistive devices and more particularly, but not by way of limitation, to walkers having an adjustable width with a removable integrated cane. In one aspect, the present invention relates to a walker including a first front leg, a first rear leg; and a first handle disposed between and connecting the first front leg to the first rear leg. The walker further comprises a trough region formed in a top surface of the first handle. The trough region has a hole formed therein. The walker further includes a cane having a grip region and a body portion. The body portion of the cane is removably received within the hole and the grip region of the cane is removably received within the trough region.

In another aspect, the present invention relates to a method of integrating a cane with a walker. The method includes providing a walker having a handle. The handle has a trough region and a hole formed therein. The method further includes providing a cane having a body portion and a grip region. The method further includes inserting the body portion through the hole such that the grip region is received and secured within the trough region.

In another aspect, the present invention relates to a walker. The walker includes a first front leg; a second front leg, a first rear leg, and a second rear leg. The walker also includes a first handle disposed between and connecting the first front leg to the first rear leg and a second handle disposed between and connecting the second front leg to the second rear leg. A trough region is formed in a top surface of the first handle. The trough region has a hole formed therein. The walker further includes a cane having a grip region and a body portion and a support brace connecting the first front leg to the second front leg. The support brace defines a width of the walker. The body portion of the cane is removably received within the hole and the grip portion of the cane is removably received within the trough region. The width is varied through selective adjustment of the support brace.

BRIEF DESCRIPTION OF THE DRAWINGS

A more complete understanding of the method and system of the present invention may be obtained by reference to the following Detailed Description when taken in conjunction with the accompanying drawings wherein.

DETAILED DESCRIPTION

Various embodiments of the present invention will now be described more fully with reference to the accompanying drawings. The invention may, however, be embodied in many different forms and should not be construed as limited to the embodiments set forth herein; rather, the embodiments are provided so that this disclosure will be thorough and complete, and will fully convey the scope of the invention to those skilled in the art.

Figure 1:
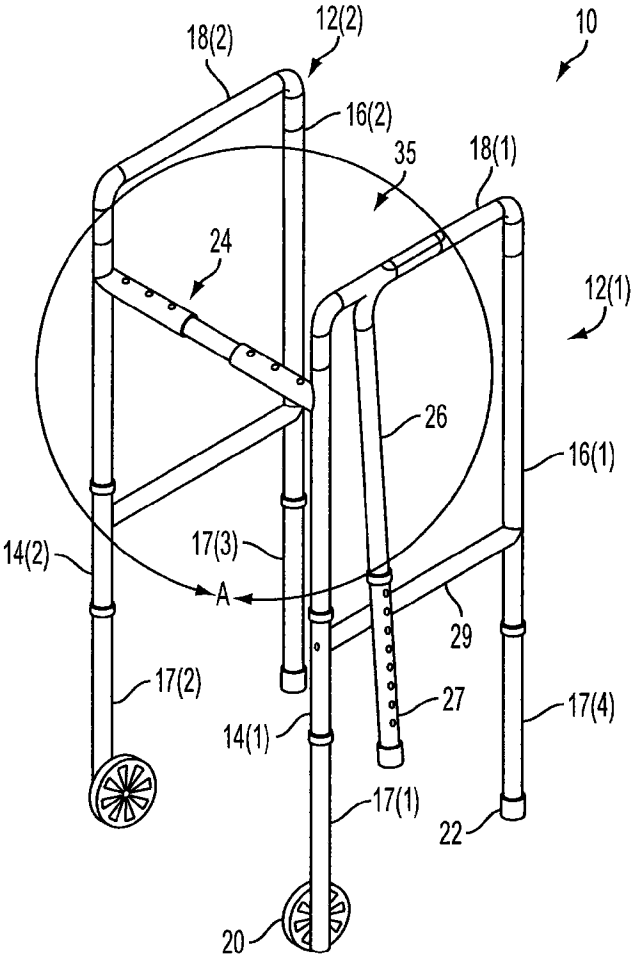
FIG. 1 is a front perspective view of a walker according to an exemplary embodiment.

FIG. 1 is a front perspective view of a walker according to an exemplary embodiment. In a typical embodiment, a walker 10 includes a first side 12(1) and a second side 12(2). The first side 12(1) includes a first front leg 14(1) and a first rear leg 16(1). The second side 12(2) includes a second front leg 14(2) and a second rear leg 16(2).

Each of the first and second front legs 14(1)-14(2) and the first and second rear legs 16(1)-16(2) includes adjustable portions 17(1)-(4). In a typical embodiment, the adjustable portions 17(1)-(4) allow the walker 10 to be vertically adjustable for use by patients of a variety of heights. The first front leg 14(1) is connected to the first rear leg 16(1) via a first handle 18(1). Likewise, the second front leg 14(2) is connected to the second rear leg 16(2) via a second handle 18(2). In a typical embodiment, each of the first and second front legs 14(1)-14(2) and the first and second rear legs 16(1)-16(2) may be equipped with, for example, wheels 20 or cane tips 22 thus making the walker 10 easier to manipulate. In a typical embodiment, the first and second front legs 14(1)-14(2) are connected to each other via a support brace 24. The support brace 24 allows the walker 10 to be adjusted to a desired width by the patient. Also, in a typical embodiment, a cane 26 is attached to the first handle 18(1). For illustrative purposes, the cane 26 is depicted in FIG. 1 as being attached to the first handle 18(1); however, in alternative embodiments, the cane 26 may be attached to the second handle 18(2). Furthermore, for illustrative purposes, the cane 26 is shown disposed outside of a cross-member 29. However, in alternative embodiments, the cane 26 may be received through a hole (not explicitly shown) disposed in the cross member 29.

Figure 2:
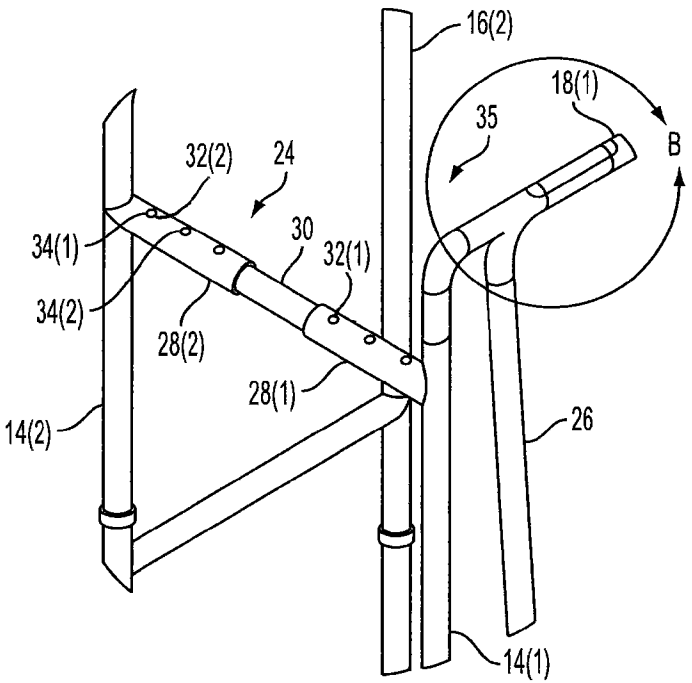
FIG. 2 is a perspective view of region A of FIG. 1 according to an exemplary embodiment.

FIG. 2 is a perspective view of region A of FIG. 1 according to an exemplary embodiment. In a typical embodiment, the support brace 24, which allows the width of the walker 10 to be adjusted, includes a pair of oppositely-disposed sleeves 28(1)-28(2) and a telescoping member 30. The oppositely disposed sleeves 28(1)-28(2) are connected to the first and second front legs 14(1)-14(2) utilizing a connection methodology such as, for example, welding, soldering, and the like. In a typical embodiment, the telescoping member 30 includes an outer diameter that is slightly smaller than an inner diameter of the oppositely-disposed sleeves 28(1)-28(2). In a typical embodiment, opposing ends of the telescoping member 30 are slid into each of the oppositely-disposed sleeves 28(1)-28(2). In a typical embodiment, the telescoping member 30 includes a plurality of spring-loaded pins 32(1)-32(2). The plurality of spring-loaded pins 32(1)-32(2) engage a plurality of holes 34(1)-34(*n*) disposed in the oppositely-disposed sleeves 28(1)-28(2) thus holding the telescoping member 30 in place. By way of example, the oppositely-disposed sleeves 28(1)-28(2) are depicted in FIGS. 1 and 2 as each having three holes located thereon; however, any number of holes could be utilized. In this manner, a width of the walker 10 may be adjusted by moving the support brace 24 relative to the pair of oppositely-disposed sleeves 28(1)-28(2).

Referring to FIGS. 1 and 2 collectively, during operation, the patient stands in a space 35 between the first side 12(1) and the second side 12(2) and grips the first and second handles 18(1)-18(2). In this manner, the patient is supported by the first and second front legs 14(1)-14(2) and the first and second rear legs 16(1)-16(2). In a typical embodiment, the exemplary walker 10 provides width adjustment capability to the patient. To adjust the width of the walker 10, the patient is required to press down on the plurality of spring-loaded pins 32(1) and 32(2). This allows the telescoping member 30 to slide in or out of each of the oppositely-disposed sleeves 28(1)-28(2). The patient then engages the plurality of spring-loaded pins 32(1)-32(2) with the holes 34(1)-34(2) to a desired width suitable for the patient. In this manner, the walker 10 is capable of being width-adjustable to allow the patient to traverse narrow doorways in a safe manner without losing the full support afforded by the walker 10. In a typical embodiment, the walker 10 is further capable of being width-adjustable to accommodate a patient requiring a wider base of support such as, for example, a bariatric patient. While the support brace 24 is depicted by way of example in FIGS. 1 and 2 as using spring-loaded pin engagement between the telescoping member 30 and the oppositely-disposed sleeves 28(1)-28(2), any type of engagement could be used such as, for example, a friction engagement having a threaded collet.

Figure 3:
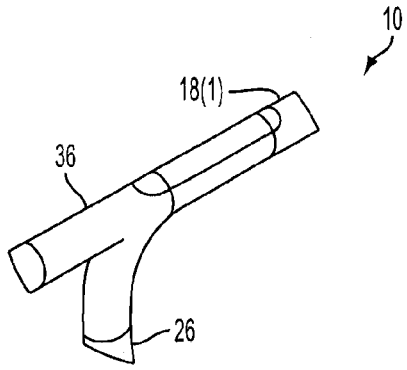
FIG. 3 is a perspective view of region B of FIG. 2 according to an exemplary embodiment.

FIG. 3 is a perspective view of region B of FIG. 2 according to an exemplary embodiment. In a typical embodiment, the cane 26 is attached to the first handle 18(1) so that a grip region 36 of the cane 26 forms a portion of the first handle 18(1). In a typical embodiment, the cane 26 includes a height-adjustment member 27 (shown in FIG. 1). The height-adjustment member 27 allows the cane 26 to be vertically adjusted for use by patients of a variety of heights. In a typical embodiment, the incorporation of the cane 26 within the walker 10 allows the patient to transition from using the walker 10 while still having the walker 10 available nearby should the patient become tired or encounter a situation where use of the walker 10 is more desirable. When not in use, the grip region 36 is secured to the first handle 18(1) without becoming dislodged. Furthermore, because the walker 10 and the cane 26 are integrated into a single device, the patient does not incur the additional expense associated with purchasing a separate walker and cane.

Figure 4:
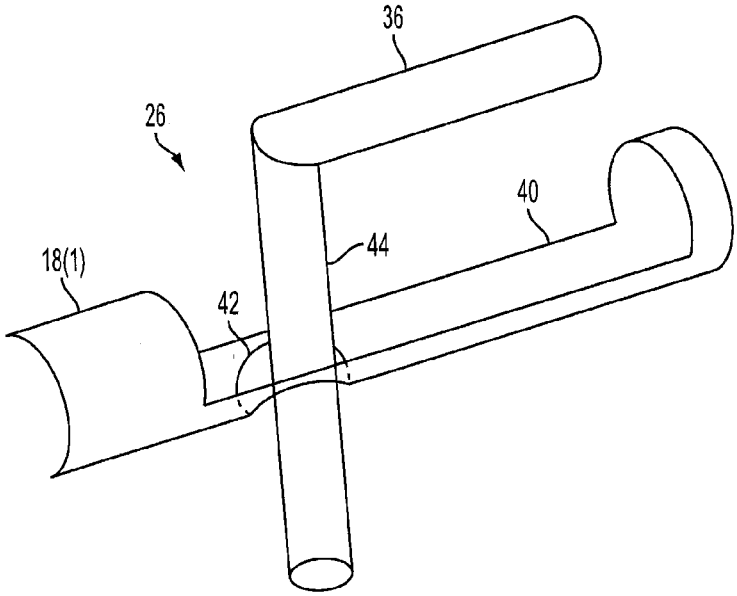
FIG. 4 is a perspective view of a cane according to an exemplary embodiment.

FIG. 4 is a perspective view of a cane according to an exemplary embodiment. In a typical embodiment, the first handle 18(1) is formed with a trough region 40 having a hole 42 disposed therein. In a typical embodiment, the hole 42 is large enough to accommodate passage of the cane 26. A body portion 44 of the cane 26 is received through the hole 42 such that the grip region 36 of the cane 26 rests in the trough region 40. During operation, when a patient desires to transition from using the walker 10 to using the cane 26, the patient lifts the grip region 36 of the cane 26 until the body portion 44 is fully disengaged from the hole 42. Additionally, a latch or a snap mechanism may be utilized to secure the cane 26 in place when not in use.

Figure 5:
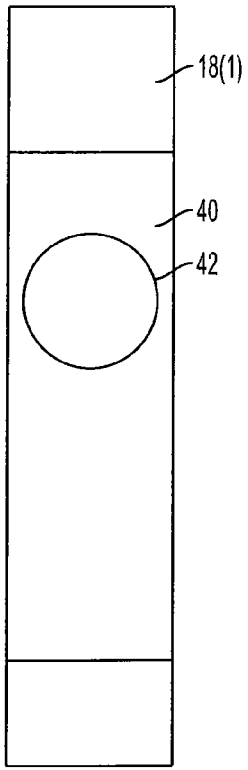
FIG. 5 is a top view of a walker handle for receiving a cane according to an exemplary embodiment.

FIG. 5 is a top view of a walker handle for receiving a cane according to an exemplary embodiment. In a typical embodiment, the first handle 18(1) is formed with a trough region 40 having a hole 42 disposed therein. A body portion 44 of the cane 26 (shown in FIG. 4) is received through the hole 42 such that the grip region 36 (shown in FIG. 4) of the cane 26 rests in the trough region 40. During operation, when a patient desires to transition from using the walker 10 to using the cane 26, the patient lifts the grip region 36 of the cane 26 until the body portion 44 is fully disengaged from the hole 42.

Figure 6:
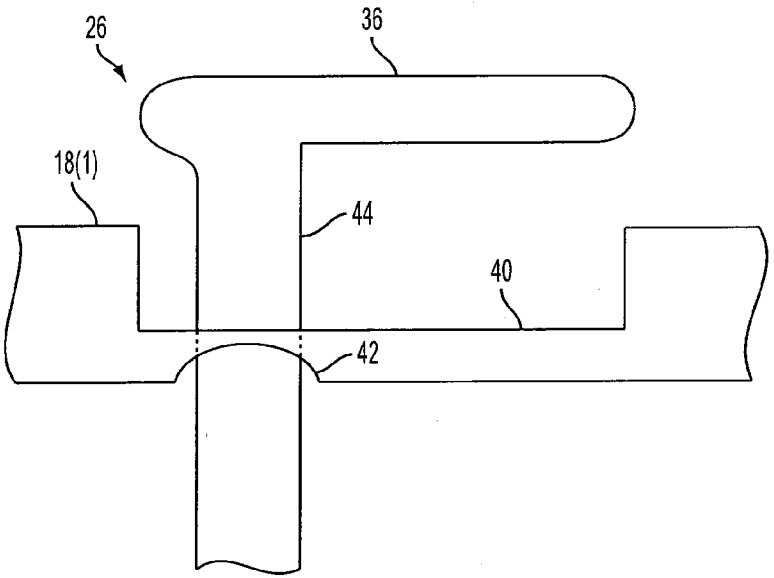
FIG. 6 is a side view of a cane according to an exemplary embodiment.

FIG. 6 is a side view of a cane according to an exemplary embodiment. In a typical embodiment, the first handle 18(1) is formed with a trough region 40 having a hole 42 disposed therein. A body portion 44 of the cane 26 is received through the hole 42 such that the grip region 36 of the cane 26 rests in the trough region 40. During operation, when a patient desires to transition from using the walker 10 to using the cane 26, the patient lifts the grip region 36 of the cane 26 until the body portion 44 is fully disengaged from the hole 42.

Figure 7:
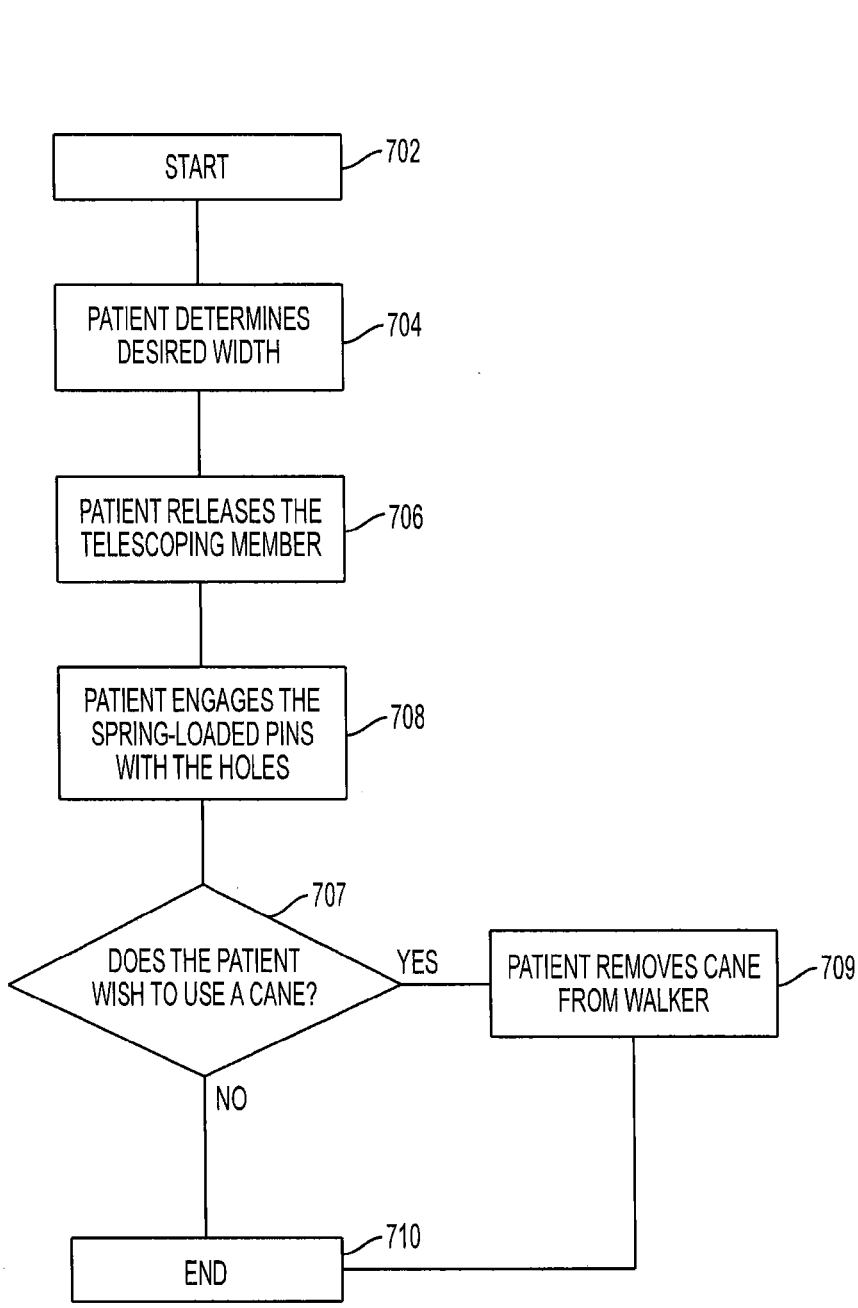
FIG. 7 is a flow diagram illustrating a process for adjusting a width of a walker according to an exemplary embodiment.

FIG. 7 is a flow diagram illustrating a process 700 for adjusting a width of the walker 10. The process begins at step 702. At step 704, a patient determines a desired width of the walker 10. At step 706, the patient presses down on the spring-loaded pins 32(1)-32(2) thereby freeing the telescoping member 30 to slide within the oppositely-disposed sleeves 28(1) and 28(2). At step 708, the patient engages the spring-loaded pins 32(1)-32(2) with the holes 34(1)-34(2) representing the desired width of the walker. At step 707, the patient decides if whether or not to use a cane. If the patient does not wish to use a cane, the process 700 ends at step 710.

At step 709, if a patient desires to transition from using the walker 10 to using the cane 26, the patient lifts the grip region 36 of the cane 26 until the body portion 44 is fully disengaged from the hole 42. The process ends at step 710.

Although various embodiments of the method and system of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein. It is intended that the specification and examples be considered as illustrative only.

What is claimed is:

1. A walker comprising:

a first front leg;

a first rear leg;

a substantially linear first handle disposed between and connecting the first front leg to the first rear leg;

a trough formed in a top surface of the first handle, an entire length of a bottom face of the trough being oriented generally parallel to the substantially linear first handle;

a hole formed in the trough;

a cane operatively coupled to the walker and comprising a grip and a body portion;

wherein the body portion of the cane is removably received within the hole; and wherein the grip of the cane is removably received within the trough, the entire length of the trough being oriented generally perpendicular to the body portion.

2. The walker of claim 1, comprising:

a second front leg;

a second rear leg;

a second handle disposed between and connecting the second front leg to the second rear leg;

a support brace connecting the first front leg to the second front leg, the support brace defining a width; and wherein the width is varied through selective adjustment of the support brace.

3. The walker of claim 2, wherein the support brace comprises:

a first sleeve connected to the first front leg;

a second sleeve connected to the second front leg; and a telescoping member slidably received within each of the first sleeve and the second sleeve.

4. The walker of claim 3, comprising a plurality of spring-loaded pins that secure the support brace to each of the first and second sleeves.

5. The walker of claim 2, comprising a wheel disposed on at least one of the first front leg, the second front leg, the first rear leg, and the second rear leg.

6. The walker of claim 2, comprising a cane tip disposed on at least one of the first front leg, the second front leg, the first rear leg, and the second rear leg.

7. The walker of claim 2, wherein at least one of the first front leg, the second front leg, the first rear leg, and the second rear leg are height adjustable.

8. The walker of claim 1, wherein the cane is height adjustable.

9. The walker of claim 1 wherein the substantially linear first handle comprises the grip.

10. The walker of claim 1, wherein the body portion, when received within the hole, is disposed between the first front leg and the first rear leg.

11. The walker of claim 1, wherein, when the body portion is received within the hole, the body portion is not disposed within either the first front leg or the first rear leg.

12. A method of integrating a cane with a walker, the method comprising:

providing a walker comprising a first front leg, a first rear leg, and a substantially linear handle, the substantially linear handle being disposed between and connecting the first front leg and the first rear leg, the substantially linear handle comprising a trough and a hole formed in the trough, an entire length of a bottom face of the trough being oriented generally parallel to the substantially linear handle;

providing a cane comprising a body portion and a grip; and inserting the body portion through the hole such that the grip is received within and secured within the trough, the length of the trough being oriented generally perpendicular to the body portion.

13. The method of claim 12, wherein the substantially linear handle is comprised at least in part of the grip.

14. A walker comprising:

a first front leg;

a second front leg;

a first rear leg;

a second rear leg;

a substantially linear first handle disposed between and connecting the first front leg to the first rear leg;

a second handle disposed between and connecting the second front leg to the second rear leg;

a trough formed in a top surface of the substantially linear first handle, an entire length of a bottom face of the trough being oriented generally parallel to the substantially linear first handle;

a hole formed in the trough;

a cane operatively coupled to the substantially linear first handle and comprising a grip and a body portion;

a support brace connecting the first front leg to the second front leg, the support brace defining a width;

wherein the body portion of the cane is removably received within the hole;

wherein the grip of the cane is removably received within the trough, the length of the trough being oriented generally perpendicular to the body portion; and wherein, the width is varied through selective adjustment of the support brace.

15. The walker of claim 14, wherein the support brace comprises:

a first sleeve connected to the first front leg;

a second sleeve connected to the second front leg; and a telescoping member slidably received within each of the first sleeve and the second sleeve.

16. The walker of claim 14, comprising a plurality of spring-loaded pins that secure the support brace to each of the first and second sleeves.

17. The walker of claim 14, comprising a wheel disposed on at least one of the first front leg, the second front leg, the first rear leg, and the second rear leg.

18. The walker of claim 14, comprising a cane tip disposed on at least one of the first front leg, the second front leg, the first rear leg, and the second rear leg.

19. The walker of claim 14, wherein at least one of the first front leg, the second front leg, the first rear leg, and the second rear leg are height adjustable.

* * * * *